US009057227B2

(12) United States Patent
Tolman et al.

(10) Patent No.: US 9,057,227 B2
(45) Date of Patent: Jun. 16, 2015

(54) PIPE HANDLING APPARATUS

(71) Applicant: Key Energy Services, LLC, Houston, TX (US)

(72) Inventors: E. Kent Tolman, Lindsay, OK (US); Troy Dean Walton, Lindsay, OK (US)

(73) Assignee: Key Energy Services, LLC, Houston, TX (US)

( * ) Notice: Subject to any disclaimer, the term of this patent is extended or adjusted under 35 U.S.C. 154(b) by 140 days.

(21) Appl. No.: 13/815,526

(22) Filed: Mar. 9, 2013

(65) Prior Publication Data

US 2013/0266404 A1 Oct. 10, 2013

Related U.S. Application Data

(60) Provisional application No. 61/622,264, filed on Apr. 10, 2012.

(51) Int. Cl.
*E21B 19/00* (2006.01)
*E21B 19/15* (2006.01)

(52) U.S. Cl.
CPC ..... *E21B 19/15* (2013.01)

(58) Field of Classification Search
USPC ..... 414/22.51–22.71, 745.1–746.8, 910, 414/911
See application file for complete search history.

(56) References Cited

U.S. PATENT DOCUMENTS

| | | | | |
|---|---|---|---|---|
| 2,900,091 | A * | 8/1959 | Minter | 414/22.62 |
| 4,067,453 | A * | 1/1978 | Moller | 414/22.61 |
| 4,371,302 | A * | 2/1983 | Frias et al. | 414/22.61 |
| 4,382,591 | A * | 5/1983 | Minnis et al. | 269/156 |
| 5,273,388 | A * | 12/1993 | Willis et al. | 414/22.54 |
| 5,294,228 | A * | 3/1994 | Willis et al. | 414/22.55 |
| 5,451,129 | A * | 9/1995 | Boyadjieff et al. | 414/22.61 |
| 6,079,925 | A | 6/2000 | Morgan et al. | |
| 6,533,519 | B1 | 3/2003 | Tolmon et al. | |
| 6,719,515 | B2 | 4/2004 | Tolmon et al. | |
| 6,969,223 | B2 | 11/2005 | Tolmon et al. | |
| 7,163,367 | B2 * | 1/2007 | Handley | 414/745.8 |
| 8,845,260 | B2 * | 9/2014 | Gerber | 414/22.54 |
| 8,888,432 | B1 * | 11/2014 | Guidroz et al. | 414/22.54 |
| 2006/0045655 | A1 * | 3/2006 | Wells | 414/22.61 |
| 2008/0101891 | A1 * | 5/2008 | Belik | 414/22.57 |
| 2009/0252576 | A1 * | 10/2009 | Gerber et al. | 414/22.54 |

FOREIGN PATENT DOCUMENTS

| | | | | |
|---|---|---|---|---|
| WO | WO 2011/011888 | * | 2/2011 | E21B 19/14 |

* cited by examiner

*Primary Examiner* — Saul Rodriguez
*Assistant Examiner* — Lynn Schwenning
(74) *Attorney, Agent, or Firm* — Keith B. Willhelm

(57) ABSTRACT

Pipe handling apparatus and methods intended to facilitate the transportation of pipe between a rig floor and a rack of pipe. The pipe handling apparatus comprise in general a loading mechanism, which transports pipe between the pipe handler and a rig, and a racking mechanism, which transport pipe between a rack and the loader. The racking mechanism is adapted to selectively transport pipe from and deliver it to various levels in a rack of pipe. The racker comprises a pair of elevators, each of which has a pipe rest which is moveable between a hold position, in which pipe may be received therein and is restricted from rolling out of the pipe rest, and a release position, in which release position pipe may roll out of the pipe rest.

25 Claims, 14 Drawing Sheets

PIPE HANDLING APPARATUS

FIELD OF THE INVENTION

The present invention relates to apparatus used to handle pipe, and more particularly, to pipe handling apparatus for transporting pipe between a drilling rig and pipe rack.

BACKGROUND OF THE INVENTION

Hydrocarbons, such as oil and gas, may be recovered from various types of subsurface geological formations. Such formations typically consist of a porous layer, such as limestone and sands, overlaid by a nonporous layer. Hydrocarbons cannot rise through the nonporous layer, and thus, the porous layer forms a reservoir in which hydrocarbons are able to collect. A well is drilled through the earth until the hydrocarbon bearing formation is reached. Hydrocarbons then are able to flow from the porous formation into the well.

In conventional drilling processes, a drill bit is attached to a series of pipe sections referred to as the drill string. The drill string is rotated and, as the drilling progresses, it is extended by adding more pipe sections. Larger diameter pipes, or casings, also are placed and cemented in the well to prevent the sides of the well from caving in. Once an appropriate depth has been reached, the casing is perforated at the level of the oil bearing formation.

If necessary, various completion processes then are performed to enhance the ultimate flow of oil from the formation. The drill string is withdrawn and replaced with a production string. Valves and other production equipment are connected to the well so that the hydrocarbons may flow in a controlled manner from the formation, into the cased well bore, and through the production string up to the surface for storage or transport. Once a well has been producing for a period of time it may become necessary to "workover" the well, that is, to repair or replace various well components or to stimulate the formation.

The rigs and equipment used to perform those operations are similar in many respects. Drilling and workover rigs both have a derrick or mast which supports a drill floor. The drill floor is elevated above ground level to accommodate various well components, such as blow out preventers, valves, and the like. A traveling block is suspended from a stationary block on the derrick crown. The traveling block is used to handle sections of pipe so that they may be added or removed from a string by workers on the rig floor.

The process of inserting and removing joints of pipe is referred to a "tripping" in and out of the well. Reducing the number of trips is a constant goal, but nevertheless many well operations require tripping in and out of the well several times. At best a well is hundreds, but more typically is several thousand feet deep. Thus, well operations necessarily entail transporting many joints of tubular members, such as drill pipe, casing, and production tubing, from a storage rack to rig floor or vice versa.

Each joint of pipe is heavy, and the rig floor also may be as much as 20 to 30 feet above ground level. Thus, various devices and systems have been developed to assist in transporting pipe between a rack and the rig floor all with a view toward increasing efficiency, minimizing handling of pipe by rig workers, and reducing risk of injury to those workers.

For example, U.S. Pat. Nos. 6,533,519, 6,719,515, and 6,969,223 to K. Tolman et al. disclose a pipe handler which has achieved considerable commercial success. Pipe is fed to a rig floor by manually rolling joints of pipe off a rack, onto the pipe handler's main platform, and into a groove in the platform. The forward end of the pipe then is elevated and moved toward the rig floor by a pusher, which pushes the rear end of the pipe laterally through the groove, and a carriage, which supports the forward end of the pipe in its elevated position. Workers on the rig then are able to use equipment on the rig to grab the pipe and move it into position for insertion into or "making up" a string. The process is then essentially reversed as the string is broken down on the rig and pipe is transported by the handler back to the rack.

It will be appreciated, however, that the particular handler illustrated in the Tolman patents is skid mounted and designed to be carried on a trailer. It also requires that pipe be rolled manually on and off the platform to and from a separate pipe rack that is essentially at the same level as the platform. Thus, the design of those handlers has been improved by building them into a trailer and by providing components designed to roll pipe into and out of the groove. Other improvements include providing area on the trailer for loading a multi-level rack of pipe and elevators for transporting pipe to and from the rack levels.

Despite the success of such designs, however, there is a continuing need to further minimize physical handling of pipe and to increase the efficiency and safety of pipe handling operations. Likewise, there is a continuing need to improve the reliability, simplicity, and serviceability of pipe handlers and thereby to reduce their costs of construction, operation, and maintenance. Such disadvantages and others inherent in the prior art are addressed by the subject invention and its various embodiments, which now will be described in the following detailed description and the appended drawings.

SUMMARY OF THE INVENTION

The subject invention provides for pipe handling apparatus for transporting pipe between a rig floor and a pipe rack. The pipe handling apparatus comprises a loading mechanism adapted to transport pipe between the pipe handling apparatus and the rig floor and a racking mechanism for transporting pipe between the loading mechanism and the pipe rack. The racking mechanism comprises an elevator having a pipe rest adapted to receive a pipe horizontally therein. The pipe rest is moveable between a hold position, in which hold position the pipe may be received therein and is restricted from rolling out of the pipe rest, and a release position, in which release position the pipe may roll out of the pipe rest. The elevator is moveable between a load position, in which load position the pipe rest is at a first elevation at which it may receive the pipe, and an unload position, in which the pipe rest is at a second elevation at which it may release the pipe by moving from its hold position to its release position.

Other embodiments of the subject invention include a pipe handling apparatus for transporting pipe between a rig floor and a pipe rack. The pipe handling apparatus comprises a loading mechanism adapted to transport pipe between the pipe handling apparatus and the rig floor and a racking mechanism for transporting pipe between the loading mechanism and the pipe rack. The racking mechanism comprises an elevator having a pipe rest. The elevator is mounted on a platform for movement between a first position wherein the pipe rest is proximate to the platform and a second position wherein the pipe rest is elevated above the platform. The pipe rest is moveable between a hold position, in which hold position the pipe received therein is restricted from rolling out of the pipe rest, and a release position, in which release position the pipe is released from the pipe rest.

Other embodiments include an apparatus for racking pipe which comprises a platform. Preferably the platform is mounted on a trailer which is adapted for hitching to a vehicle so that the trailer may be transported to and from a site. The platform is adapted to support a rack of the pipe. A cradle is mounted on a support. The support is adapted for movement such that the cradle may be positioned at defined elevations above the platform corresponding to levels in the rack. The cradle is pivotably mounted on the support for movement between a hold position, in which hold position the pipe received therein is restricted from rolling out of the pipe rest, and a release position, in which release position the pipe may roll out of the cradle onto to the rack.

Yet other embodiments include the some or all of the foregoing embodiments wherein the pipe rest comprises a cradle adapted to receive the pipe. The cradle is pivotably mounted to the top of the elevator and adapted to pivot between the hold position and the release position.

Other embodiments include some of all of the foregoing embodiments wherein the cradle comprises a support portion and a stop portion and/or wherein the elevator comprises a post which is slidably mounted on the platform for vertical movement between its positions.

Still other embodiments include some or all of the foregoing embodiments wherein the apparatus comprises a tensile member, wherein the tensile member supports the elevator and may be actuated to move the elevator between its positions; wherein the apparatus comprises a tensile member extending between first and second mounts and supporting the elevator post wherein at least one of the mounts is translatable so that the elevator post may be moved between its positions by translating the mount; and/or wherein the tensile member is a chain and the elevator post comprises an idler sprocket mounted on the lower end of the elevator post and engaging the chain.

Other embodiments include some or all of the foregoing embodiments wherein the elevator post is biased downward.

Further embodiments include some or all of the foregoing embodiments wherein the loading mechanism comprises a platform having a groove formed therein. The groove has a first end and an opposing second end and is adapted to receive a pipe therein. The pipe has a first end and an opposing second end. The loading mechanism also includes a carriage aligned with the groove and adapted to support the first end of the pipe at a position elevated relative to the second end of the pipe and a pusher aligned with the groove. The pusher is moveable along the groove between an, extended position approaching the first end of the groove and a retracted position proximate to the second end of the groove. The pipe may be received in the groove in a substantially parallel relationship thereto when the pusher is in the retracted position; and wherein the pusher is adapted to engage the second end of the pipe when the first end of the pipe is supported on the carriage and the pusher is in the extended position.

Yet other embodiments include methods of transporting pipe from a rig floor to a rack of pipes. The methods comprise transporting a pipe from the rig floor to a pipe racking apparatus. The pipe racking apparatus having a pipe rest mounted on an elevator. The pipe rest is moveable between a hold position, in which hold position the pipe received therein is restricted from rolling out of the pipe rest, and a release position, in which release position the pipe is released from the pipe rest. The elevator is moveable between a load position wherein the pipe rest is remote from a level of the pipe rack to an unload position in which the pipe rest is adjacent to the level of the pipe rack. The pipe is transported to the pipe rest when the elevator is in its load position and the pipe rest is in its hold position. The elevator is actuated to move the elevator from the load position to the unload position, whereby the pipe rest is adjacent to the level of the pipe rack. The pipe rest is then actuated to move the pipe rest from the hold position to the release position, whereby the pipe is released onto the pipe rack at the level.

Other embodiments include methods of transporting pipe from a rig floor to a rack of pipe that comprise transporting a pipe from the rig floor to a pipe rest mounted on an elevator where the elevator is at a load level and the pipe rest is in a hold position in which it retains the pipe therein. The elevator then is moved vertically to an unload level and the pipe rest is moved to a release position in which the pipe is released from the pipe rest onto the rack.

Still other embodiments include methods of transporting pipe from a rig floor to a rack of pipe, or methods of moving pipe on and off a rack of pipe using any of the pipe handling apparatus or pipe racking apparatus described herein.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1A:
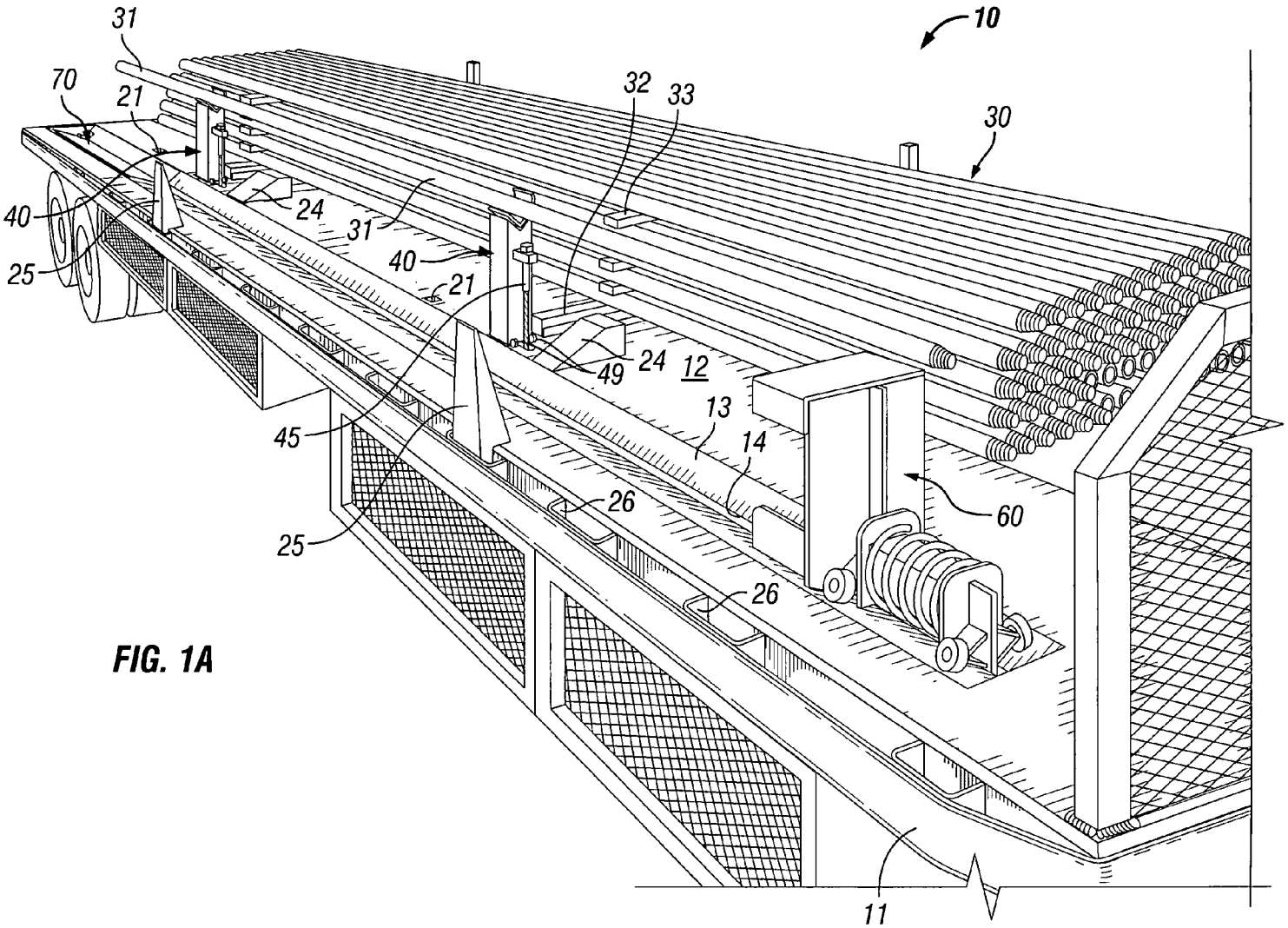
FIG. 1A is a perspective view, taken slightly above and generally from the front and to the left, of a preferred embodiment 10 of the pipe handlers of the subject invention, wherein a trailer has a rack of pipe and a pipe has been rolled off rack and onto elevators for unloading to a rig (not shown)

In the drawings and description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The pipe handling apparatus and methods of the subject invention are intended to facilitate the transportation of pipe between a rig floor and a rack of pipe. Various embodiments comprise in general a loading mechanism, which transports pipe between the pipe handler and a rig, and a racking mechanism, which transport pipe between a rack and the loader. In particular, the novel pipe handlers have improved racking mechanisms by which pipe may be selectively transported from and delivered to various levels in a to rack of pipe.

For example, FIGS. 1 and 2 show a preferred embodiment 10 of the pipe handling apparatus of the subject invention. Pipe handler 10, as may be seen therefrom, is mounted on a trailer 11. Trailer 11 has a generally flat, horizontal platform 12 which supports a rack 30 of pipe 31. As seen for example in FIG. 1A, rack 30 extends over the major portion of the right side of platform 12 from a point somewhat rearward of the front of trailer 11. Trailer 11 typically will be loaded, subject to its load capacity, with as much pipe as may be required for a particular job.

Pipe handler 10 also comprises a racking mechanism and a loading mechanism. The racker consists primarily of a pair of elevators 40, each of which has a pipe rest, such as cradles 41. The racker is adapted to receive pipe from a rack and transport it to a loader. For example, the racker in pipe handler 10 delivers a pipe 31 to a groove 13 defined in platform 12. Groove 13 runs generally parallel to rack 30 along the left side and nearly the length of trailer 11.

The loading mechanism consists primarily of a pusher 60 and a carriage 70. The loader is adapted to transport pipe from the pipe handler to a rig, for example, from groove 13 towards the floor of a rig (not shown). The loader then transports pipe back from the rig floor and, via a pair of kick-out arms 20, back onto the racker. The racker than transports pipe back to the rack.

A drive/control system 22, which is shown schematically in FIG. 2 and which includes various conventional controls, motors, and pumps, is provided on trailer 11 for driving and controlling the various mechanical, hydraulic, and electrical systems incorporated into pipe handler 10. Drive/control system 22 and its various components are of conventional construction and design and may easily be adapted for use in the novel handlers. Hard wire or wireless remote controllers also may be provided. Levelers 23 also preferably are provided to level and stabilize trailer at a well site.

Mounting the novel pipe handlers on a trailer greatly simplifies and reduces the cost of transporting the handlers. A trailer may be hitched to a truck for transportation to and from well sites. Once at a site, the trailer will be backed up so that its rear end will be suitably positioned for transporting pipe to and from the rig floor. Although trailer mounting is preferred, the novel pipe handlers may be provided on any suitable supporting structure and transported by any suitable means. For example, they may be built on a skid mounted support frame which is transported via flatbed trailer or rail car.

Unracking Pipe

Figure 2A:
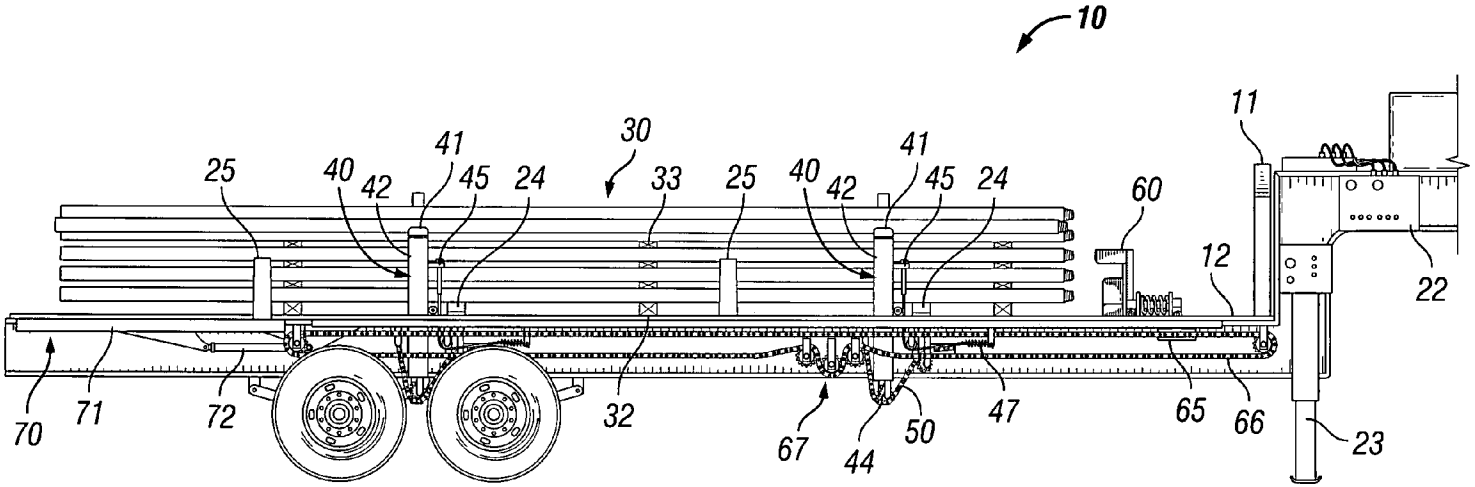
FIG. 2A is a side elevation view of pipe handler 10 in which, as in FIG. 1A, pipe has been removed from rack and placed on elevators for unloading to the rig (not shown)
Figure 4B:
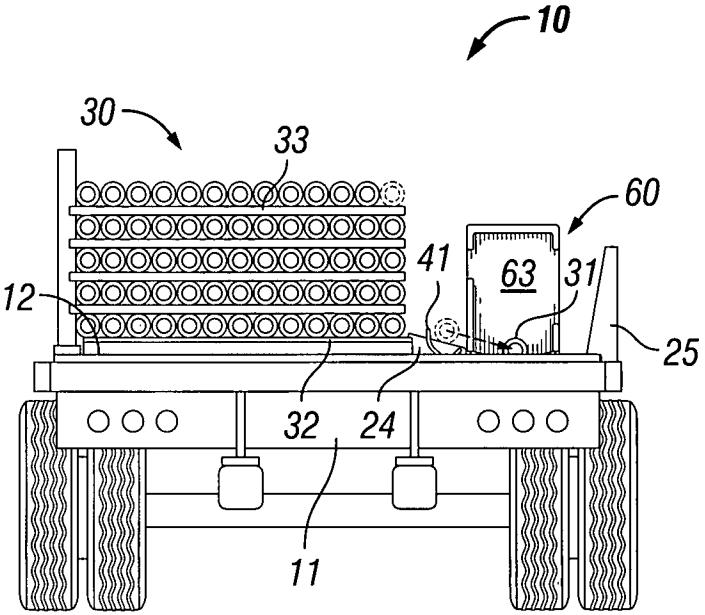
FIG. 4B is a rear elevation view of pipe handler 10 similar to FIG. 4A in which, as in FIGS. 1B and 2B, pipe has been rolled into groove for further transport to the rig.
Figure 4A:
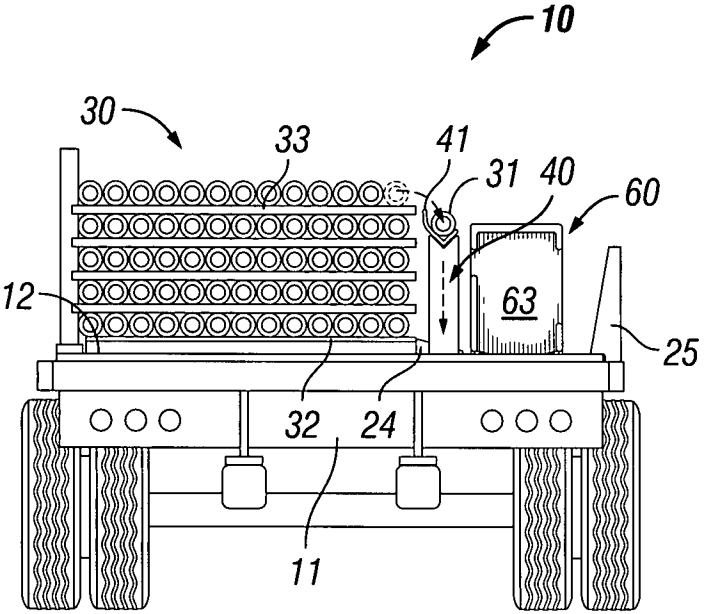
FIG. 4A is a rear elevation view of pipe handler 10 in which, as in FIGS. 1A and 2A, pipe has been removed from rack and placed on elevators for unloading to the rig (not shown)

The improved pipe handlers of the subject invention, such as pipe handler 10 shown in the figures, preferably are designed to transport pipe from various levels of a rack of pipe so that they may be further transported toward a rig floor. More particularly, FIGS. 1A, 2A, and 4A show pipe handler 10 with essentially a full rack 30 of pipe. Rack 30 consists of multiple levels and perhaps embodies the simplest of rack designs. A bottom layer of pipe may be supported directly on platform 12, but preferably it loaded on support members disposed on platform 12, such as 4×4 timbers 32. Additional support members preferably are provided above each successive layer of pipe, such as 2×4 boards 33. Support members 32 and 33 provide a smooth surface over which pipe may be rolled and provide separation between pipe layers so that individual pipes may be more easily manipulated.

It will be appreciated, however, that pipes may be racked by other means and apparatus. A rack having pivoting or stationary cantilevered support arms may be provided. Levels of pipe also may be stacked directly on each other, although doing so would make it more difficult to rack the pipe. In addition, while providing a rack on the same trailer on which a pipe handler is mounted is preferred, that is not necessary. Doing so may eliminate the need to transport additional trailers to a site, but a rack may be provided on a separate trailer, or may be set up and loaded on site, either in lieu of or in addition to a rack provided on the handler trailer if desired. In any event, a rack is provided and positioned so that pipe may be rolled from the rack onto the racker.

The improved pipe handlers preferably are adapted to receive pipe from various level of a rack and deliver them to a loading mechanism. For example, elevators 40 of pipe handler 10 are mounted on platform 12 such that they are able to extend vertically to greater and lesser degrees above the surface of platform 12. They are shown in FIGS. 1A, 2A, and 4A at or near their full vertical extension. More specifically, cradles 41 are elevated some distance above platform 12, at a level adjacent to the top layer of rack 30 so that pipe may be rolled off rack 30 and into cradles 41, as best seen perhaps in FIG. 4A.

Figure 9:
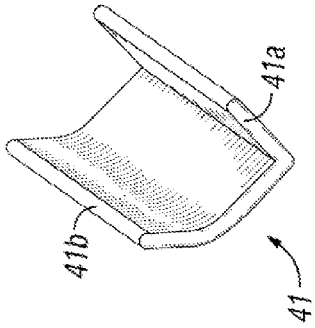
FIG. 9 is a perspective view of cradle 41 of pipe handler 10.

Cradles 41, as seen best in FIG. 4A and FIG. 9, have a lower, support portion 41*a* which has a generally v-shaped cross-section and is adapted to receive pipe 31, pipe 31 being supported within two generally upstanding sides of lower portion 41*a*. The inner side 41*b* of cradles 41 is elongated in a more or less vertical direction, thereby providing as discussed below a stop portion. Cradles 41, as discussed in greater detail below, are mounted for pivotal movement, but are shown in FIGS. 1A, 2A, and 4A in a position such that pipe 31 is held therein. That is pipe 31 will rest in the bottom, v-shaped support portion 41*a* of cradles 41 and is substantially prevented from rolling, and certainly from rolling to a degree that under normal use pipe will be precluded from rolling out of cradles.

Figure 8A:
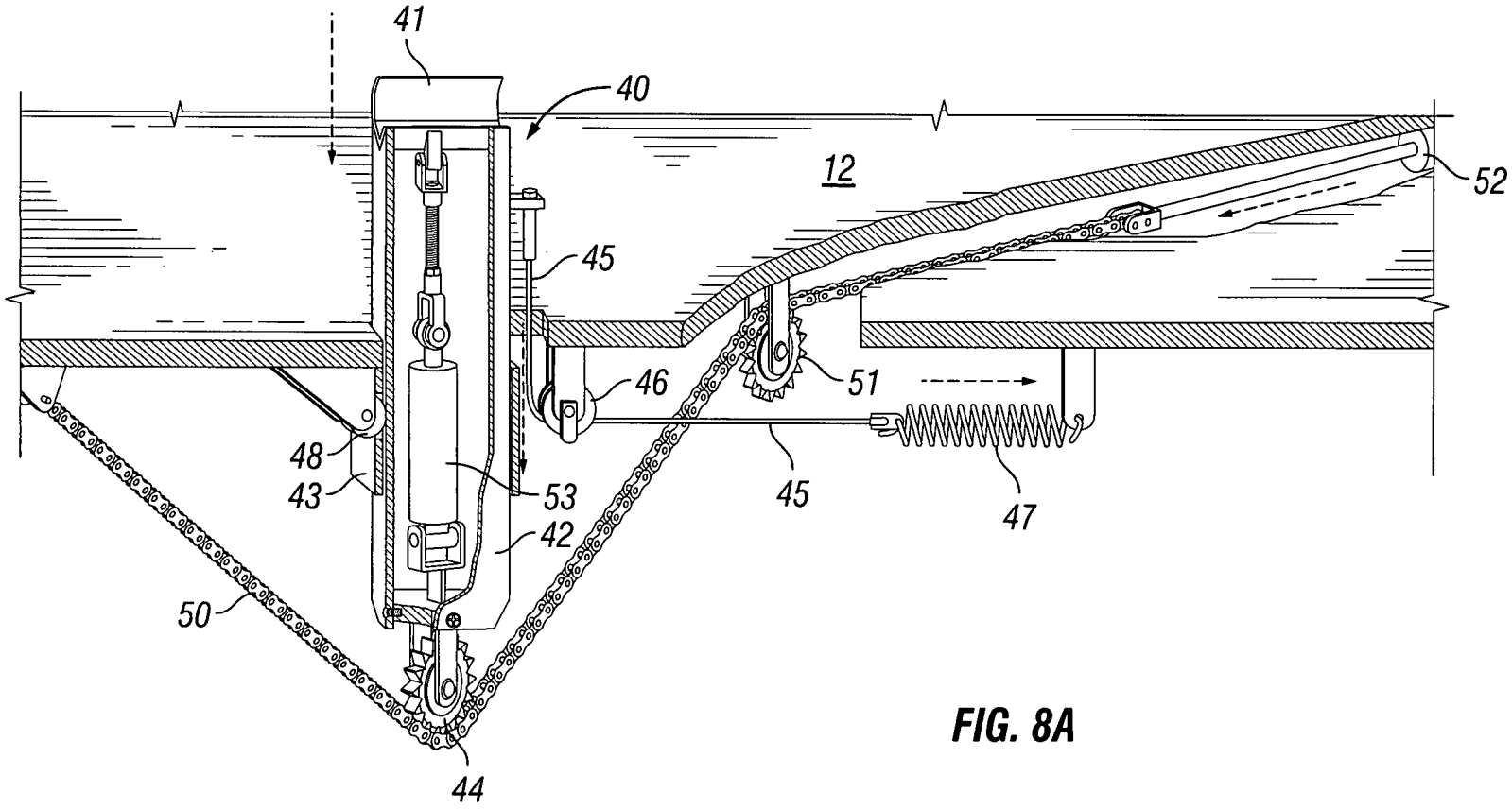
FIG. 8A is a cross-sectional and tear away view of one of the elevators of pipe handler 10 showing elevator in a lowered position and pipe rest in a hold position.
Figure 8B:
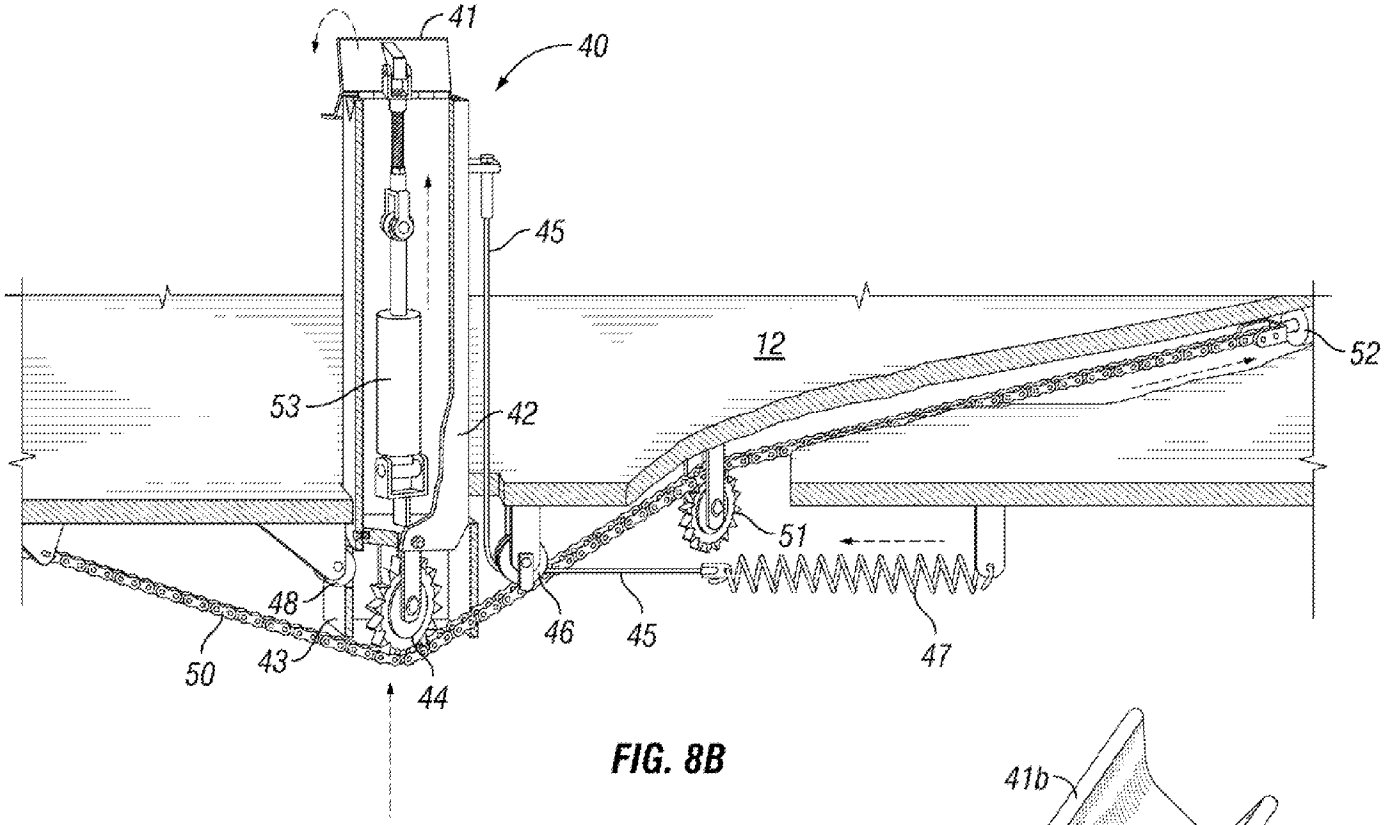
FIG. 8B is a view similar to FIG. 8A showing elevator in a raised position and pipe rest in a release position.

FIGS. 8A and 8B show the construction of elevators 40 in greater detail. As may be seen therein, elevators 40 comprise a post 42 which is slidably received in a guide 43. Guide 43 extends downwardly from platform 12 and allows post 42 to travel vertically. Elevators 40 and, in particular, posts 42 incorporated therein may be supported and actuated by a tensile member, such as a cable or chain. For example, an idler sprocket 44 is mounted on the lower end of posts 42. Idler sprocket 44 engages a chain 50 which is secured at one end to platform 12 by suitable connectors. Chain 50 passes over an idler sprocket 51 mounted underneath platform 12 and is attached at its other end to a hydraulic cylinder 52. As will be appreciated by comparing FIGS. 8A and 8B, when hydraulic cylinder 524 is retracted, chain 50 will urge post 42 upward through guide 43. If not mechanically, at least visually chain 50 may be thought of as going from a "slacked" state to an "unslacked" state, where post 42 is lowered by slacking chain 50 and raised by taking the slack out of chain 50. Hydraulic cylinders 52 for each elevator 40 preferably are synchronized for common control and operation through conventional hydraulic circuits so that the risk of pipe sliding off elevators 40 is minimized.

While the chain mechanism described above provides reliable and effective actuation of the elevator posts, other actuation mechanisms may be used in other embodiments of the subject invention. For example, a hydraulic cylinder may be directly connected to elevator posts and used to raise and lower the posts. Rack gears also may be provided on the elevator posts and driven through sprockets with electric motors. Other mechanisms known in the art may also be used.

Various mechanisms also are preferably provided to assist and facilitate the travel of post 42 in guide 43. For example, post 42 typically will move downward with ease when elevators 40 are loaded with a pipe 31, but less so when they are not. Thus, a cable 45 is affixed at one of its ends to post 42, passed over a stationary pulley 46, and connected at its other end to a tension spring 47. Spring 47, via connecting cable 46, biases post 42 downward and help ensure more reliable operation of elevators 40. In addition, a single roller 48 engages a surface of post 42 through an opening in guide 43. A pair of rollers 49 is mounted on the upper surface of platform 12 and engage the opposite side of post 42, as may be seen best in FIGS. 1A and 1G. Rollers 48 and 49 help ensure that posts 42 will slide more smoothly and reliably through guides 43 even if they are subject to torque during their operation.

Figure 1B:
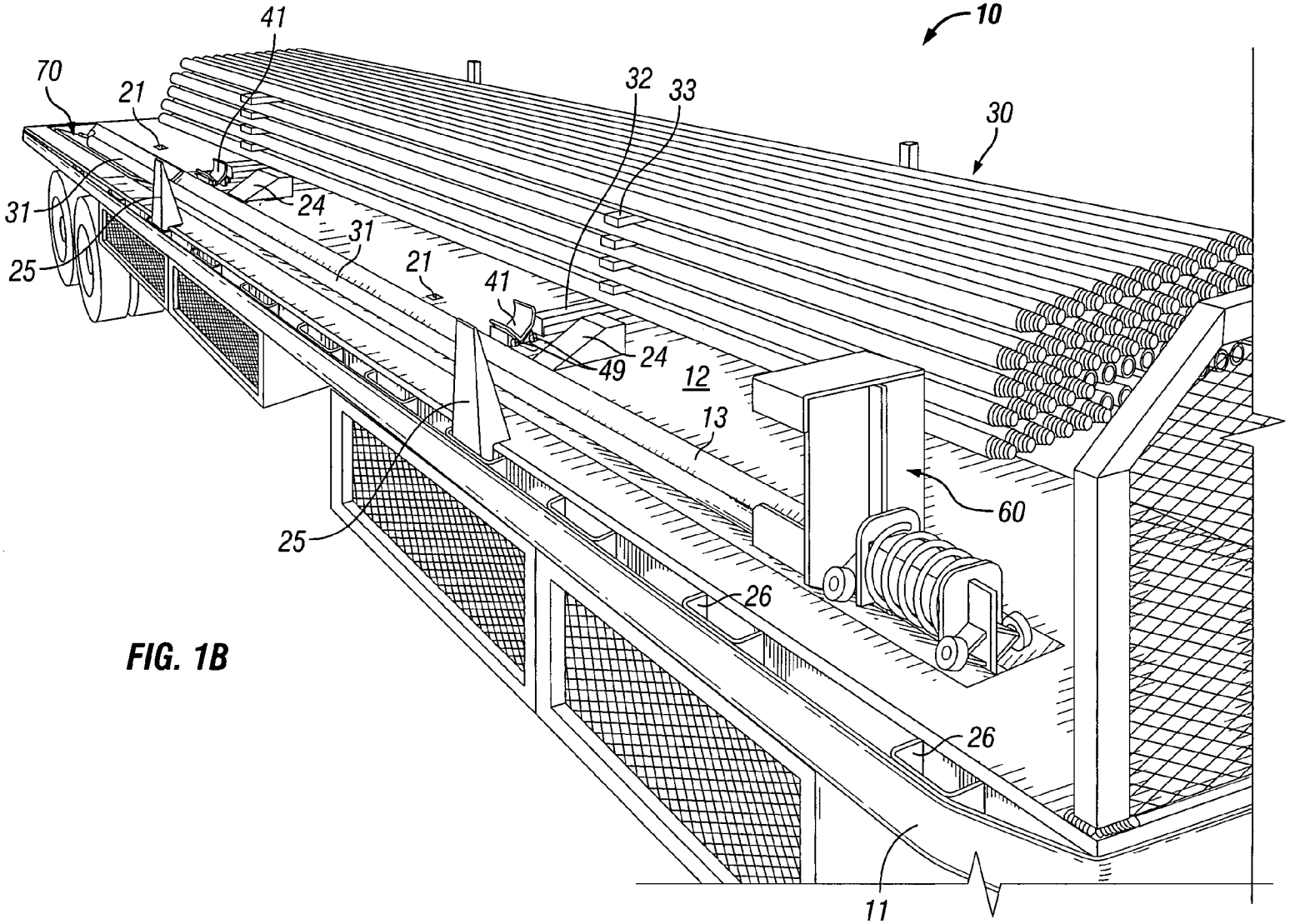
FIG. 1B is a perspective view of pipe handler 10 similar to FIG. 1A wherein pipe has been rolled into a groove for further transport to the rig.
Figure 1C:
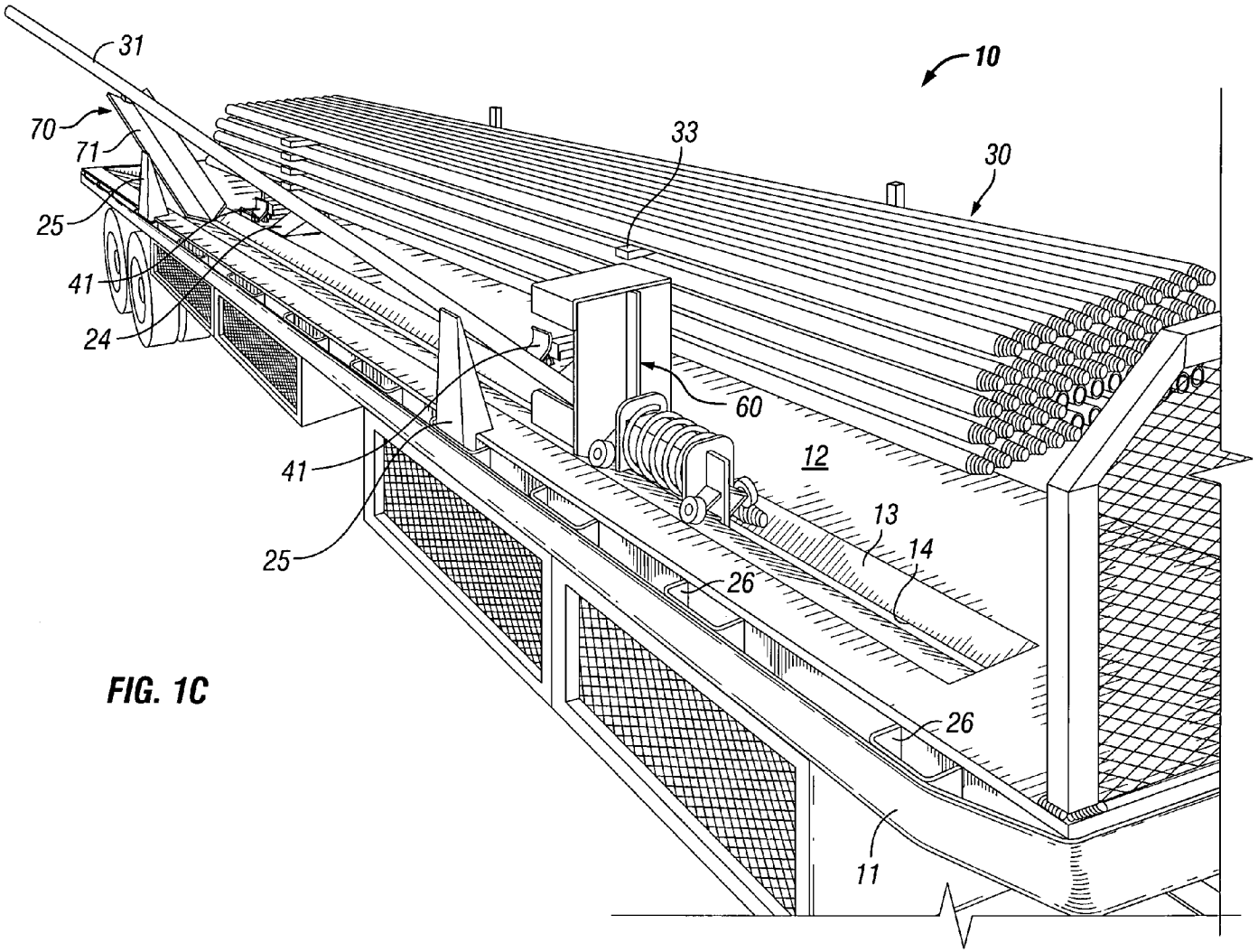
FIG. 1C is a perspective view of pipe handler 10 similar to FIGS. 1A and 1B wherein pipe has been lifted and pushed toward the rig.
Figure 2B:
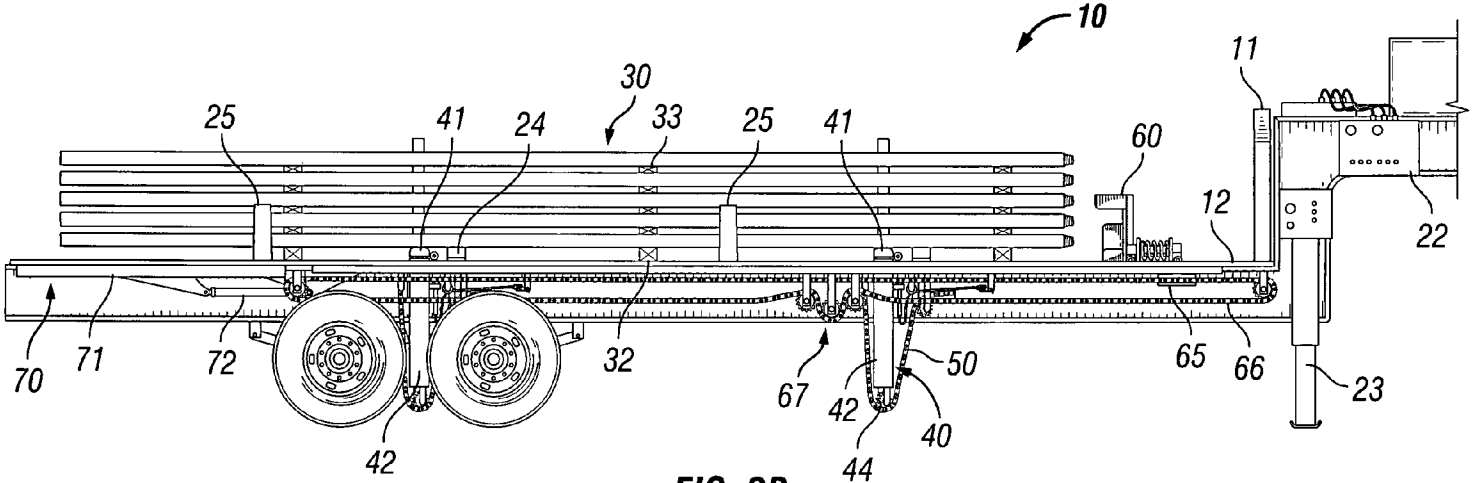
FIG. 2B is a side elevation view of pipe handler 10 similar to FIG. 2A in which, as in FIG. 1B, pipe has been rolled into groove for further transport to the rig.
Figure 2C:
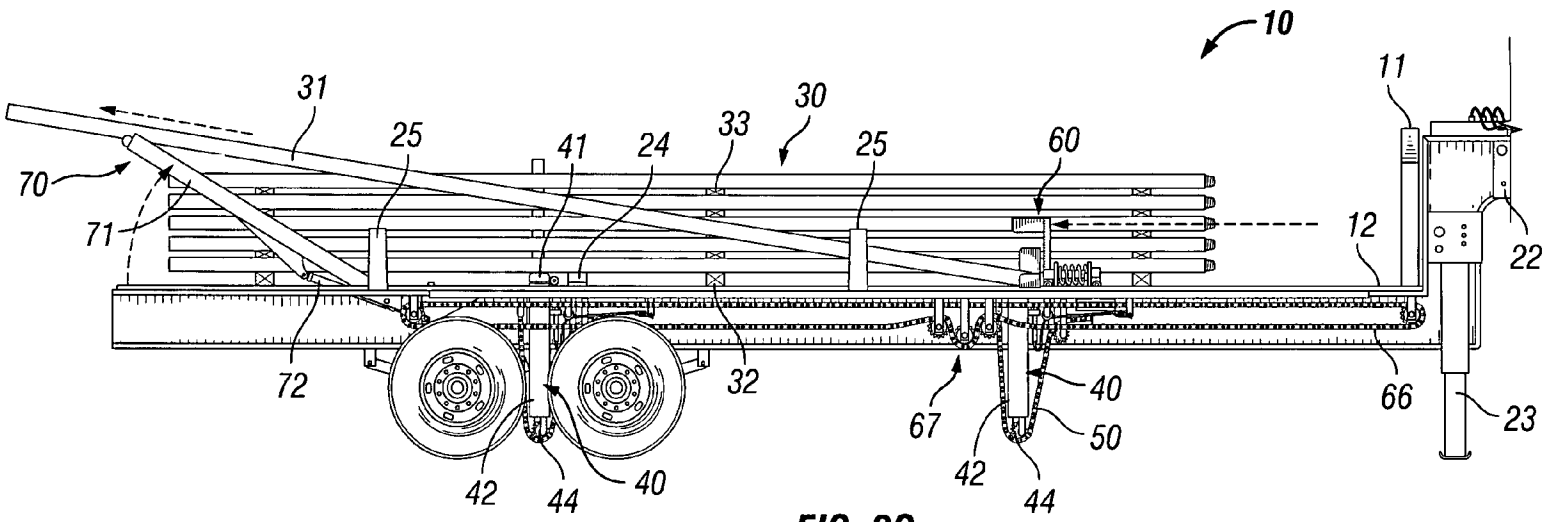
FIG. 2C is a side elevation view of pipe handler 10 similar to FIGS. 2A and 2B in which, as in FIG. 1C, pipe has been lifted and pushed toward the rig.

In any event, once a pipe has rolled onto the racker, the racker preferably will deliver it to the loading mechanism so that the pipe is positioned for transport toward a rig floor. For example, once pipe 31 has rolled into cradles 41 of elevators 40, as shown in FIGS. 1A, 2A, and 4A, posts 42 are lowered to a position proximate platform 12 as shown in FIGS. 1B, 2B, and 4B. As cradles 41 approach platform 12, pipe 31 carried therein will engage ramps 24 which are provided on platform 12. Ramps 24 have upper surfaces which are sloped toward groove 13. Ramps 24 are situated sufficiently close to groove 13 so that pipe 31 will roll out of cradles 41, down the surfaces of ramps 24, and into groove 13.

When incorporated into various embodiments of the invention, a groove such as groove 13 in pipe handler 10 serves as a sump, that is, a recess into which pipe is allowed to settle and is positioned so that it may be moved by loader toward a rig floor. Thus, groove 13 has opposing sloped surfaces that define a generally v-shaped cross-section against which pipe will come to rest. Since its momentum will vary depending on its weight, which may vary depending on the type of pipe being handled, and other factors, a mechanism preferably is provided to ensure that pipe will not roll through groove and off the platform. For example, as seen best in FIG. 1, handler 10 has a pair of stops 25. Stops 25 have a generally wedged shaped upper portion and downwardly projecting tabs (not shown) which may be inserted into corresponding slots 26 in trailer 11. Trailer 11 preferably is provided with a series of slots 26 along its left side so that stops 25 may be positioned as desired for a particular job.

A slot 14 runs the length of groove 13. Slot 14 serves primarily to allow engagement and travel of pusher 60 through and along groove 13. The width of slot 14, however, may be coordinated so that pipe is positioned and supported therein. Similarly, a slot may be provided on a flat surface, eliminating any opposing sloped surfaces. Workers in the art, therefor, will readily understand that grooves, as used herein, include all such configurations and other sump designs. Likewise, stops, catches and the like may be provided to position pipe so that it may be picked up by the loader.

Loading Pipe on Rig

In any event, once pipe has rolled off the racker and is positioned for pickup, the loader will be actuated to move pipe toward a rig floor. Loaders in large part are of conventional design. As is typical, they may comprise a mechanism for elevating (or lowering) one end of a pipe and a mechanism for pushing (or resisting) the other end of a pipe so that it may be raised and moved toward (or lowered and moved away from) a rig floor.

Figure 3:
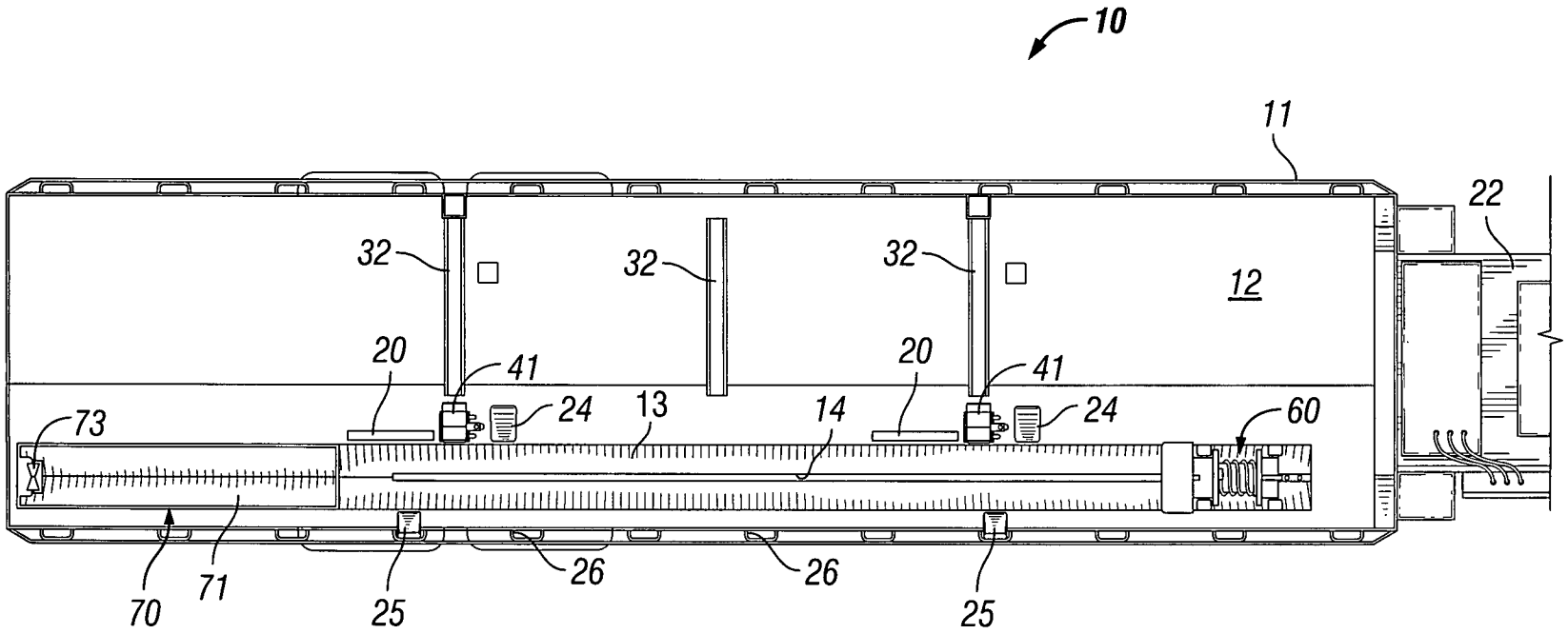
FIG. 3 is a plan view of pipe handler 10.

For example, as will be appreciated by comparing the various views in FIG. 1 and FIG. 3, groove 13 extends along a substantial length of platform 12. A first, rear end of groove 13 terminates near the rear of trailer 11. Its other, front end terminates near the front of trailer 11. Trailer 11 will be positioned near the rig such that groove 13 is pointing toward that portion of the rig floor onto which, and off which pipe will be loaded. Pusher 60 travels along groove 13 between an extended position approaching the rear end of groove 13 and a retracted position proximate to the front end of groove 13. The length of groove 13 and of the travel of pusher 60 through groove 13, as will be appreciated by workers in the art, may be varied considerably to, best accommodate pipe of differing lengths.

Figure 7:
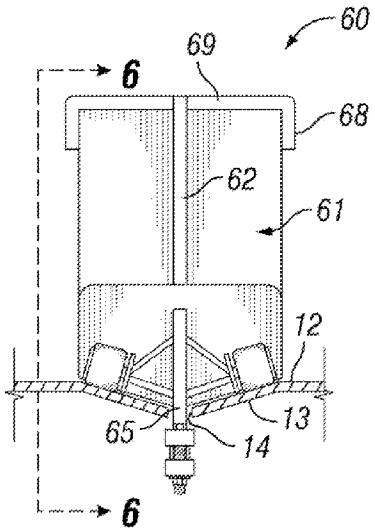
FIG. 7 is cross-section taken along line 7-7 of FIG. 6 through platform of pipe handler 10 showing a front elevation view of pusher.
Figure 6:
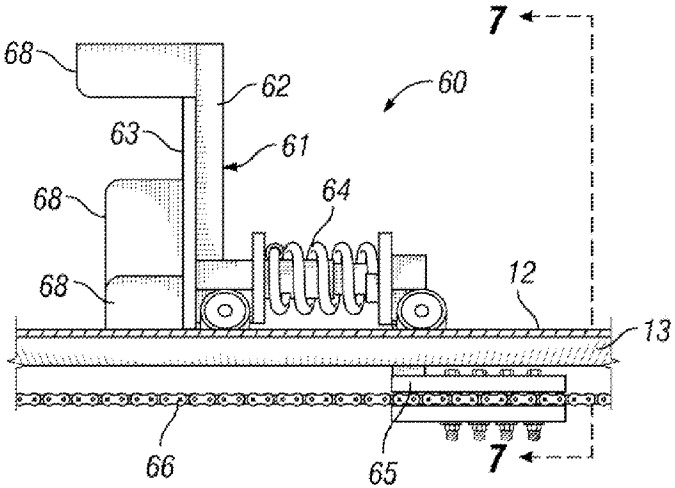
FIG. 6 is a cross-section taken along line 6-6 of FIG. 7 through platform of pipe handler showing a side elevation view of a travelling pusher mounted on pipe handler 10.

Pusher 60, as may be seen best in FIGS. 6 and 7, comprises a wheeled dolly 61 which has a rear-facing stop 62. Stop 62 is adapted to engage the trailing end of pipe 31 on a bearing plate 63 extending vertically above and perpendicularly across groove 13. Since the engagement of pipe 31 with stop 62, especially when pipe is unloaded from a rig floor, may involve impacts of significant momentum, dolly 61 preferably is provided with a spring biased, telescoping body 64 designed to absorb the shock of those impacts. A tongue 65 extends below dolly, through slot 14, and is connected to a chain 66. Chain 66 is part of a drive mechanism 67, shown generally in FIG. 2, which includes various drive and idler sprockets and pulls pusher 60 back and forth in groove 13. (It should be noted that cowlings shown in FIG. 1 have been removed in FIG. 2 to show chain 66, pusher drive mechanism 67, and other mechanisms not otherwise visible in those views.)

The subject invention, however, is not limited to such pusher designs. Other pushers and drive systems may be used as desired. For example, a dolly may be adapted to slide over a groove or platform, or on a track provided underneath a platform. A dolly also could be driven by cables or other tensile members, by hydraulic cylinders, or other actuating mechanisms as are known in the art.

Figure 5:
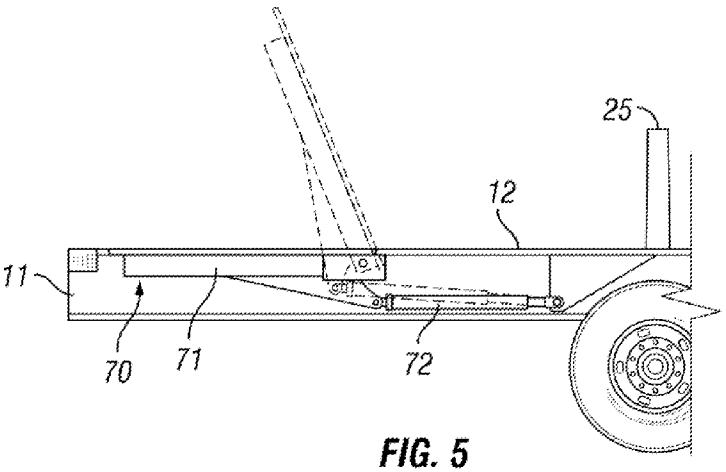
FIG. 5 is a side elevation view of a pivoting carriage mounted on pipe handler 10.

Pusher 60 is operated in cooperation with carriage 70 to raise and move pipe toward a rig floor. As may be seen in FIG. 5, carriage 70 generally comprises a pivoting arm 71 which is actuated by a hydraulic cylinder 72. Carriage arm 71, as best appreciated by viewing FIG. 1, defines a generally v-shaped channel that more or less matches and extends from the rear end of groove 13. A roller 73, as seen best in FIG. 3, is mounted at the end of arm 71. Carriage arm 71, and especially roller 73 is adapted to support the leading end of pipe 31 in an elevated position relative to its trailing end which is engaged by pusher 60 in groove 13.

That is, when pusher 60 is retracted, that is, positioned near the front end of groove 13 as shown in FIGS. 1B, 2B, and 4B, pipe 31 is able to settle into groove 13 where it is supported in a substantially horizontal position. Pipe 31, being relatively long, extends horizontally into the channel of carriage arm 71 as well. Shorter pipe, however, depending on where it is racked, may roll into groove 13 without extending over carriage 70. The invention is not limited to use of the apparatus with any particular length of pipe, and the novel handlers may be configured to accommodate a wide variety of pipe having varying diameters and length.

In either event, once pipe 31 has settled into groove 13, pusher 60 and carriage 70 are actuated such that pusher 60 is extended toward the rear end of groove 13 and carriage arm 71 is pivoted upward away from platform 12. The precise degree and timing of those operations is not necessarily critical. For example, carriage arm 71 may be raised first and then pusher 60 actuated, or vice versa, or they may be actuated more or less simultaneously, or alternately. They may be actuated so that leading end of pipe 31 is lifted by carriage arm 71, is ramped up the channel in carriage arm 71, or is lifted in part and ramped in part. The precise manner in which actuation of the pusher 60 and carriage 70 is coordinated may depend on the relative orientation of the rig floor or the size and weight of pipe being handled, or it may simply be a matter of operator preference or expediency. In any event, as will be appreciated from in FIGS. 1C and 2C, pusher 60 and carriage 70 are manipulated such that the trailing end of pipe 31 is pushed toward the rig and the leading end is supported in an elevated position where it may be grabbed by equipment controlled by workers on the rig floor. The rig equipment then lifts pipe 31 by its leading end up and onto the rig floor.

Unloading Pipe From Rig

Unloading pipe from a rig floor with loaders as described above in large part is the reverse of the operations used to load pipe. Equipment on the rig grabs and lifts pipe by its upper, or what will become its trailing end. The bottom or leading end is swung away from rig and into groove. The operation of the pusher and carriage and release of pipe by the rig equipment is coordinated such that pipe is again supported on the carriage at one end in an elevated position and at the other end in the groove by the pusher. The primary difference in the operations is other mechanisms preferably are provided to assist in delivering pipe to the racker.

For example, pipe handler 10 is provided with pivotable kick-out arms 20 which are operated in coordination with pusher 60 and carriage 70 to deliver pipe to the racker. Since they will interfere with unracking operations, kick-out arms 20 are adapted to be releasably mounted on platform 12. During unracking and loading operations kick-out arms 20 are stowed. They then may be installed on pipe handler 10 by an operator in preparation for unloading pipe from a rig.

More specifically, as best appreciated when viewed from the side as in FIG. 4C, kick-out arms 20 have a framed upper portion, the upper frame member of which provides a ramped surface. An inner vertical frame member extends downward to provide a pin (not shown) which is inserted into a corresponding recess 21 in rotatable mounts provided underneath platform 12. Recesses 21 of the rotatable mounts may be seen in FIGS. 1A and 1B, wherein kick-out arms 20 have not been installed. Mount recesses 21 and pins on kick-out arms 20 have a rectangular (as shown) or other geometric cross section. The mounts are rotatable, for example, by a hydraulically actuated linkage or other mechanism, and preferably the mount actuators are linked so that their operations may be synchronized. Thus, kick-out arms 20 may be pivoted between a retracted position generally parallel to groove 13, as seen, e.g., in FIG. 2F, to an extended position generally perpendicular to groove 13, as seen, e.g., in FIG. 1D.

Figure 1D:
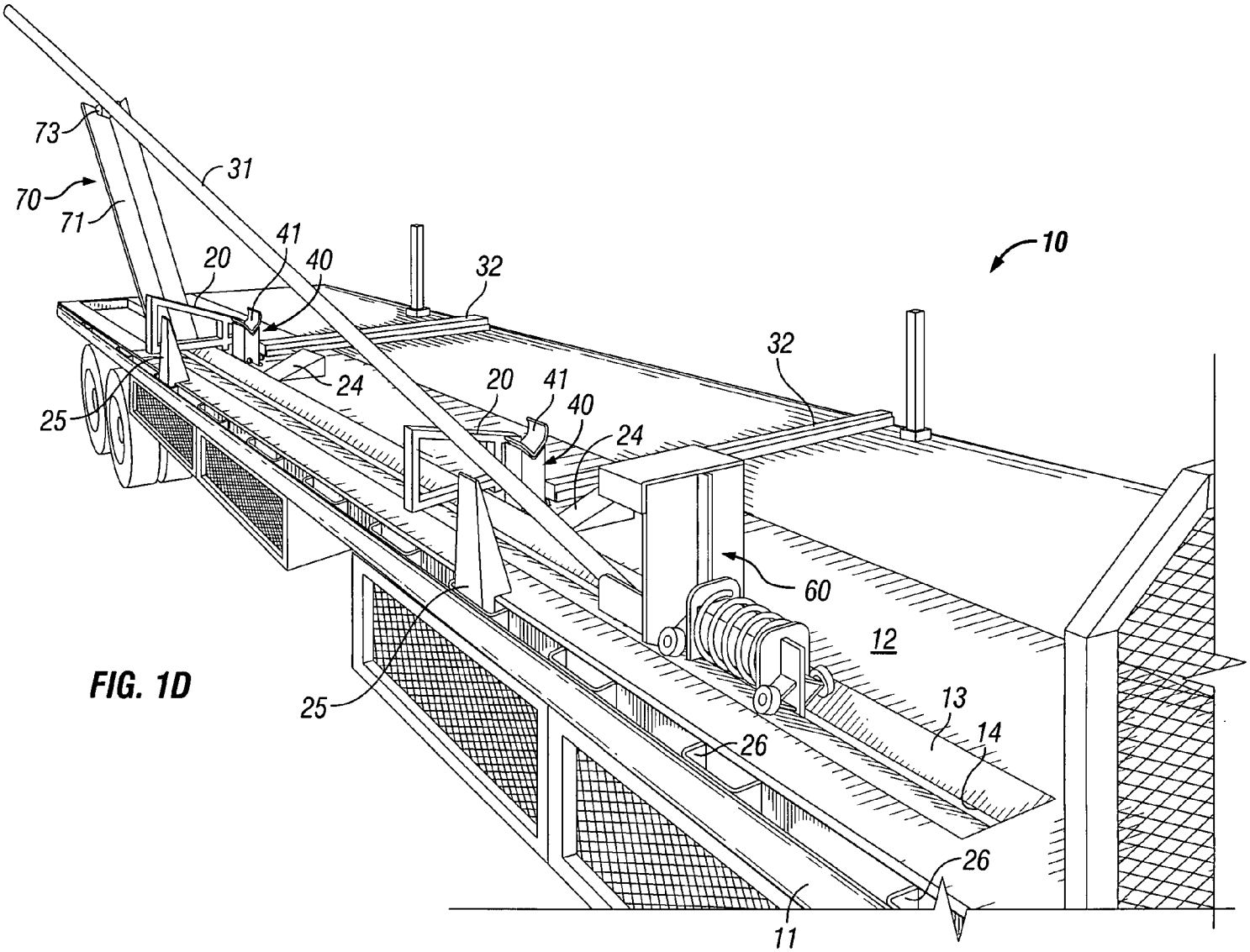
FIG. 1D is a perspective view of pipe handler 10 similar to FIGS. 1A to 1C wherein pipe has been offloaded from the rig onto pipe handler 10.
Figure 2D:
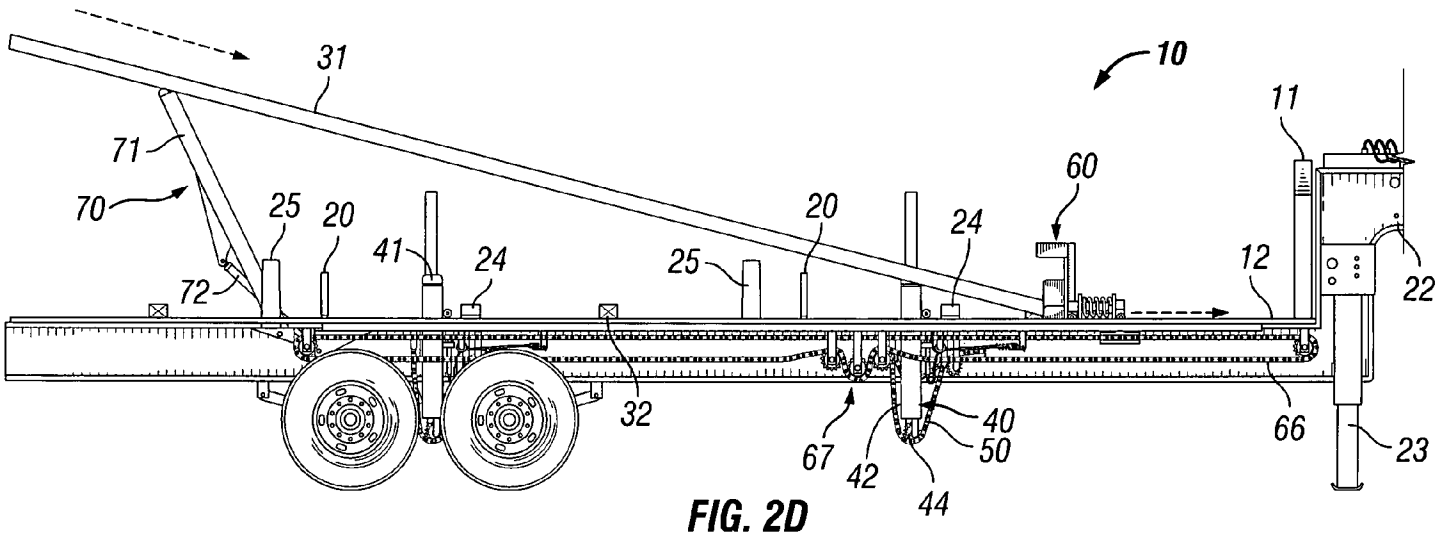
FIG. 2D is a side elevation view of pipe handler 10 similar to FIGS. 2A to 2C in which, as in FIG. 1D, pipe has been offloaded from the rig onto pipe handler 10.
Figure 2E:
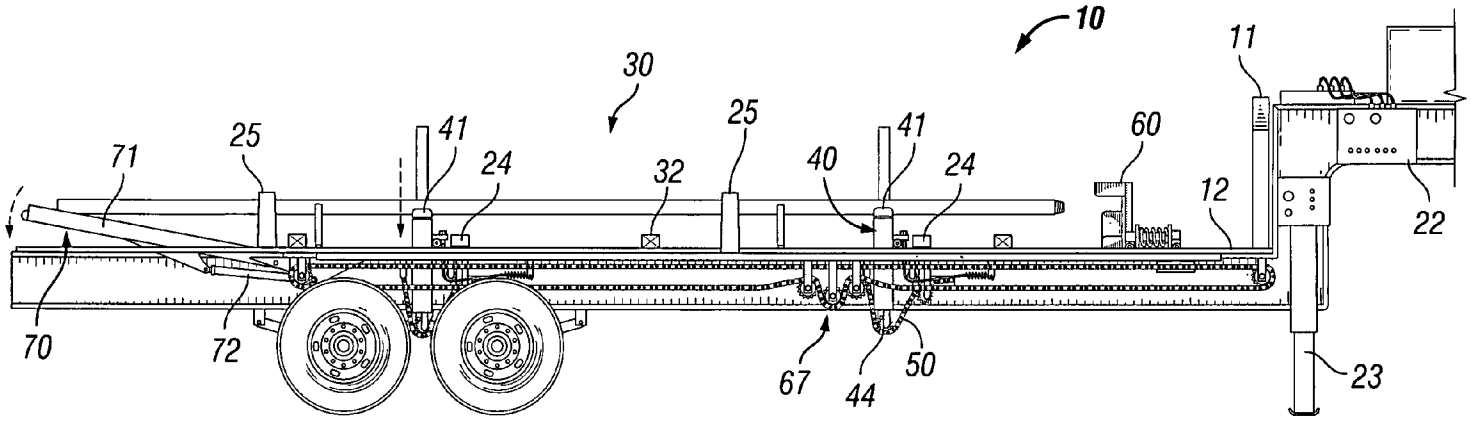
FIG. 2E is a side elevation view of pipe handler 10 similar to FIGS. 2A to 2D wherein pipe has rolled into elevators for placement on rack.

As pipe is unloaded from a rig onto pipe handler 10, kick-out arms 20 initially are in their retracted position generally parallel to groove 13. The leading end of pipe 31 being unloaded from the rig, therefore, is able to slide forward in groove 13 unimpeded by kick-out arms 20. Pusher 60 and carriage 70 are manipulated such that pipe 31 eventually is supported in and above groove 13, the trailing end being elevated and supported on carriage 70 and the leading end resting in groove 13 and abutting bearing plate 63 of pusher 60. The angle and position of pipe 31, as best seen in FIGS. 1D and 2D, is such that kick-out arms 20 then may be pivoted under pipe 31 to their extended position generally perpendicular to groove 13.

Figure 4F:
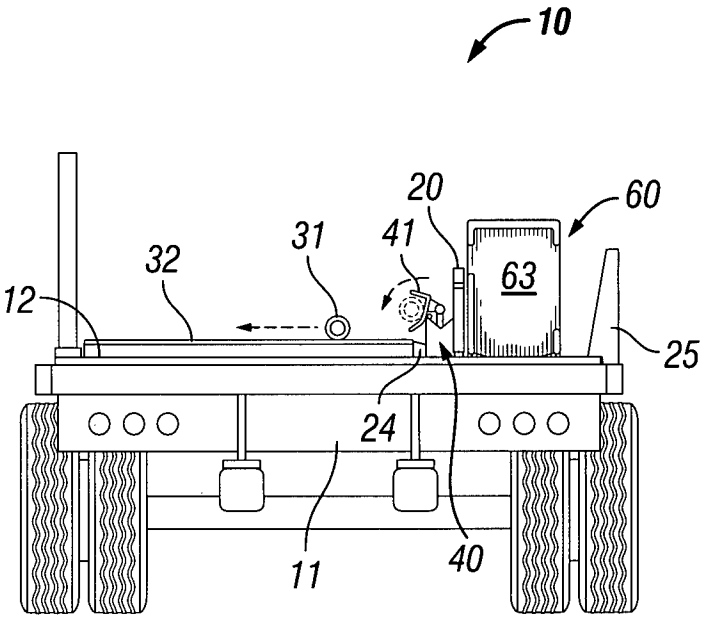
FIG. 4F is a rear elevation view of pipe handler 10 similar to FIGS. 4A, 4B, and 4E in which, as in FIG. 2F, pipe has been released onto rack.
Figure 4E:
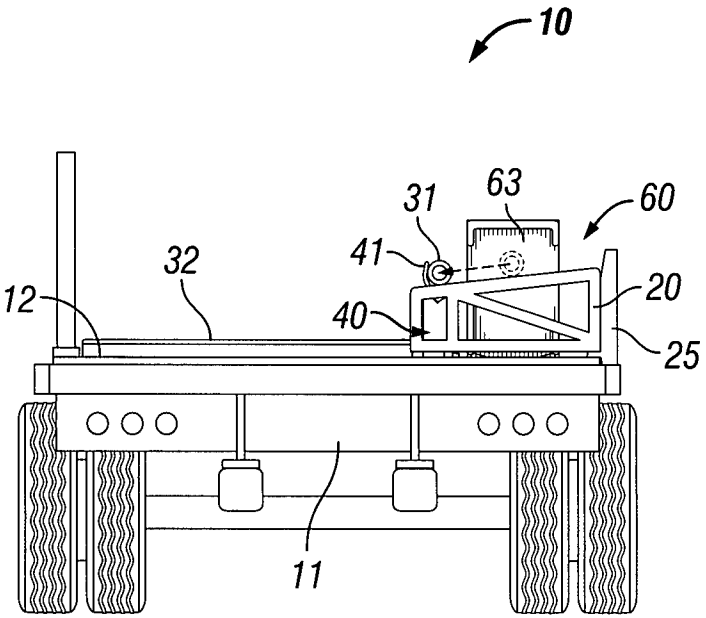
FIG. 4E is a rear elevation view of pipe handler 10 similar to FIGS. 4A and 4B in which, as in FIG. 2E, pipe has rolled into elevators for placement on rack.

More or less at the same time, elevators 40 are brought into position for loading. That is, as best seen perhaps in FIGS. 1D and 4E, the height of elevators 40 is adjusted so that the lower, pipe-receiving portion of cradles 41 is just below the level of upper frame of kick-out arms 20. When so positioned, the outer side of cradles 41 is below the level of the upper, ramped surface of kick-out arms 20 while the elongated inner side or stop portion 41*b* of cradles 41 projects well above kick-out arms 20. Thus, as pipe 31 is further lowered by carriage 70 and pusher 60 toward groove 13 and onto kick-out arms 20, it will roll down the upper ramped surface of kick-out arms 20 and come to rest directly above the bottom, v-shaped support portion 41*a*, and against elongated inner side 41*b* of cradles 41, as best seen in FIG. 4E, Elevators 40 then are raised so that cradles 41 pick up pipe 31 and carry it above kick-out arms 20, after which kick-out arms 20 may be pivoted back to a position parallel to groove 13. Less preferably, kick-Out arms 20 may be rotated out from under pipe 31, allowing it to drop into cradles 41.

It will be appreciated that during the process of placing pipe 31 on kick-out arms 20, the leading end of pipe 31 initially will tend to rest in groove 13 against the lower portion of pusher bearing plate 63. As carriage 70 and trailing end of pipe 31 is lowered and pusher 60 is returned to its retracted position, pipe 31 initially will contact forward kick-out arm 20*a*. Forward kick-out arm 20*a* will then act as a pivot point about which pipe 31 can pivot as pipe 31 is further lowered, which may cause leading end of pipe 31 to ride up the bearing plate 63 of pusher stop 62. At the same time, forward kick-out arm 20*a* will tend to urge that leading end of pipe 31 inwardly down its ramped upper surface. Pusher stop 62, therefore, is provided with vertical 68 and horizontal ears 69 projecting from the periphery of bearing plate 63. Those ears 68 and 69 will restrict movement the leading end of pipe 31 across bearing plate 63 of stop 62 and thereby encourage pipe 31 to stay oriented more or less in the vertical plane extending above groove 13 until the trailing portion of pipe 31 has been lowered onto the rear kick-out arm 20*b*. Once pipe 31 is again substantially horizontal, i.e., resting on both kick-out arms 20, it then is able to roll down kick-out arms 20 through a gap extending between inner vertical ears 68 on pusher stop 62.

Racking Pipe

Figure 2F:
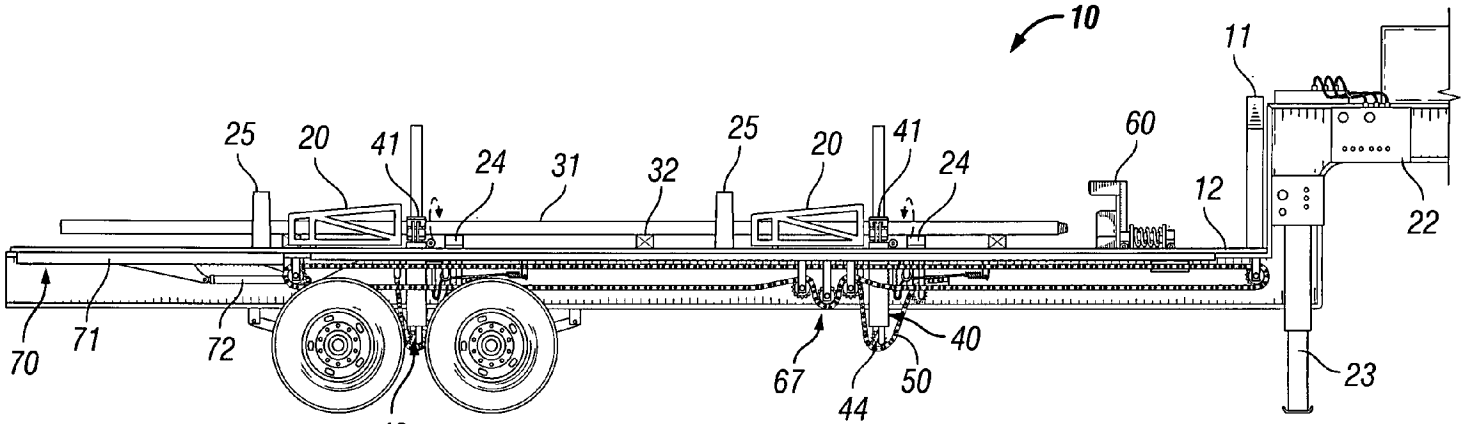
FIG. 2F is a side elevation view of pipe handler 10 similar to FIGS. 2A to 2E wherein pipe has been released onto rack.

Once pipe been delivered to the racker, it is operated to selectively deliver it to various levels in the rack. For example, as shown in FIGS. 2F and 4F, elevators 40 may be lowered from their load position to an unload position in which cradles 41 are adjacent to the lowest level of rack 30. Cradles 41, as may best be appreciated from viewing FIG. 8, are pivotally mounted to the top of elevator posts 42. They may be pivoted by actuating a hydraulic cylinder 53 which is connected thereto by suitable linkage. Other drive mechanisms, however, may be used to pivot cradles 41, such as traveling gears, rotating cams, and the like.

Figure 1G:
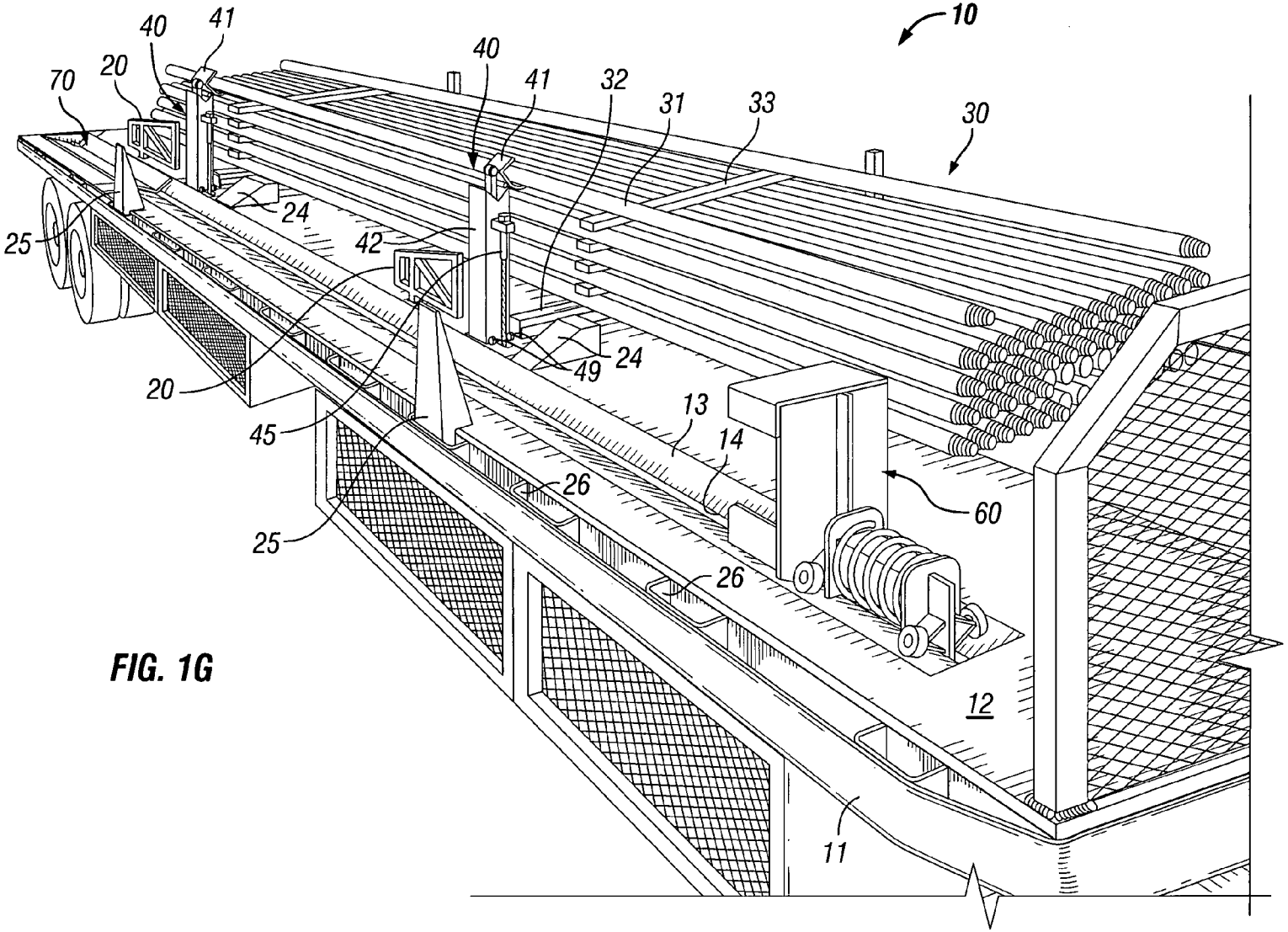
FIG. 1G is a perspective view of pipe handler 10 similar to FIGS. 1A to 1D wherein pipe has been released onto rack.

In any event, once elevators 40 have been moved to an unload position, cradles 41 are pivoted, as best seen in FIG. 4F, to a release position, allowing pipe 31 to roll out of cradles 41 onto rack 30. The process of unloading and racking pipe then may be repeated, with elevators 40 being selectively moved to unload positions adjacent other levels of rack 30, until rack 30 is fully loaded, as shown in FIG. 1G.

As will be appreciated from the foregoing description, the apparatus and methods of the subject invention are not limited to a particular type of pipe or even pipe per se. They may be adapted for use with drill pipe, production pipe, casing, and other tubulars as are commonly put into use in drilling, completing, and workover of oil and gas wells.

While this invention has been disclosed and discussed primarily in terms of specific embodiments thereof, it is not intended to be limited thereto. Other modifications and embodiments will be apparent to the worker in the art.

What is claimed is:

1. A pipe handling apparatus for transporting pipe between a rig floor and a pipe rack, said pipe handling apparatus comprising a loading mechanism adapted to transport pipe between said pipe handling apparatus and said rig floor and a racking mechanism for transporting pipe between said loading mechanism and said pipe rack, said racking mechanism comprising:

(a) an elevator comprising an elongated, vertically extending post and having a pipe rest adapted to receive a pipe horizontally therein;

(b) said pipe rest being mounted on said elevator for rotation along a horizontal axis above said elevator post between a hold position, in which hold position said pipe may be received in said pipe rest and is restricted from rolling out of said pipe rest, and a release position, in which release position said pipe may mil out of said pipe rest;

(c) a platform extending horizontally between said pipe rack and said loading mechanism;

(d) said elevator post being mounted for vertical movement through an opening in said platform between a load position, in which load position said pipe rest is at a first elevation at which it may receive said pipe, and an unload position, in which said pipe rest is at a second elevation at which it may release said pipe by moving from its hold position to its release position.

2. The apparatus of claim 1, wherein said pipe rest comprises:

(a) a cradle adapted to receive said pipe;

(b) said cradle being pivotably mounted to the top of said elevator post and adapted to pivot between said hold position and said release position.

3. The apparatus of claim 2, wherein said cradle comprises a support portion in which said pipe may rest and a stop portion extending vertically from a side of said support portion.

4. The apparatus of claim 1, wherein said pipe handling apparatus comprises a tensile member, wherein said tensile member supports said elevator post and may be actuated to move said elevator post vertically between said load and unload positions.

5. The apparatus of claim 1, wherein said apparatus comprises:

(a) a tensile member extending between first and second mounts and supporting said elevator post;

(b) wherein at least one of said mounts is translatable, whereby said elevator post may be moved vertically between said load and unload positions by translating said mount.

6. The apparatus of claim 5, wherein said tensile member is a chain and said elevator post comprises an idler sprocket mounted on the lower end of said elevator post, said idler sprocket engaging, said chain.

7. The apparatus of claim 1, wherein said elevator post is biased downward.

8. The pipe handling apparatus of claim 1, wherein said loading mechanism comprises:

(a) a platform having a groove formed therein, said groove having a first end and an opposing second end and being adapted to receive a pipe therein;

(b) said pipe having a first end and an opposing second end;

(c) a carriage aligned with said groove and adapted to support said first end of said pipe at a position elevated relative to said second end of said pipe;

(d) a pusher aligned with said groove, said pusher moveable along said groove between an extended position approaching said first end of said groove and a retracted position proximate to said second end of said groove, (e) wherein said pipe may be received in said groove in a substantially parallel relationship thereto when said pusher is in said retracted position; and (f) wherein said pusher is adapted to engage said second end of said pipe when said first end of said pipe is supported on said carriage and said pusher is in said extended position.

9. The apparatus of claim 1, wherein said elevator comprises a drive mechanism operably connected to said elevator post, said drive mechanism adapted to move said elevator post between its said load and unload positions.

10. The apparatus of claim 2, wherein said elevator comprises a drive mechanism operably connected to said elevator post, said drive mechanism adapted to move said elevator post between its said load and unload positions.

11. A pipe handling apparatus for transporting pipe between a rig floor and a pipe rack, said pipe handling apparatus comprising a loading mechanism adapted to transport pipe between said pipe handling apparatus and said rig floor and a racking mechanism for transporting pipe between said loading mechanism and said pipe rack, said racking mechanism comprising:

(a) an elevator comprising an elongated, vertically extending post and having a pipe rest adapted to receive a pipe horizontally therein;

(b) a platform extending horizontally between said pipe rack and said loading mechanism;

(c) said elevator post being mounted for vertical movement through an opening in said platform between a first position wherein said pipe rest is proximate to said platform and a second position wherein said pipe rest is elevated above said platform;

(d) said pipe rest being mounted on said elevator for rotation relative to a horizontal axis above said elevator post between a hold position, in which hold position said pipe received in said pipe rest is restricted from rolling out of said pipe rest, and a release position, in which release position said pipe is released from said pipe rest.

12. The apparatus of claim 11, wherein said pipe rest comprises:

(a) a cradle adapted to receive said pipe;

(b) said cradle being pivotably mounted to the top of said elevator post and adapted to pivot between said hold position and said release position.

13. The apparatus of claim 11, wherein said elevator comprises a drive mechanism operably connected to said elevator post, said drive mechanism adapted to move said elevator post between its said first and second positions.

14. The apparatus of claim 11, wherein said pipe handling apparatus comprises a tensile member, wherein said tensile member supports said elevator post and may be actuated to move said elevator post vertically between its said first and second positions.

15. An apparatus for racking pipe, said apparatus comprising:

(a) a platform adapted to support a rack of said pipe;

(b) a cradle mounted on an elongated, vertically extending post, said post being mounted for vertical movement, through an opening in said platform such that said cradle may be positioned at defined elevations above said platform corresponding to levels in said rack by moving said post vertically through said platform;

(c) said cradle being pivotably mounted on the top of said post for movement between a hold position, in which hold position said pipe received in said cradle is restricted from rolling out of said cradle, and a release position, in which release position said pipe may roll out of said cradle on to said rack.

16. The apparatus of claim 15, wherein said platform is mounted on a trailer, said trailer adapted for hitching to a vehicle whereby said trailer may be transported to and from a site.

17. The apparatus of claim 15, wherein said pipe racking, apparatus comprises a drive mechanism operably connected to said post, said drive mechanism adapted to move said post vertically to position said cradle at said defined elevations.

18. The apparatus of claim 15, wherein said pipe racking apparatus comprises a tensile member, wherein said tensile member supports said post and may be actuated to move said post vertically to position said cradle at said defined elevations.

19. A method of transporting pipe from a rig floor to a rack of pipes, said method comprising:

(a) transporting a pipe from said rig floor to a pipe racking apparatus;

(b) said pipe racking apparatus having a pipe rest mounted on an elevator comprising an elongated, vertically extending post and a horizontally extending platform adjacent said pipe rack;

(c) Wherein said pipe rest is mounted on said elevator for rotation relative to a horizontal axis above said elevator post between a hold position, in which hold position said pipe received in said pipe rest is restricted from rolling out of said pipe rest, and a release position, in which release position said pipe is released from said pipe rest;

(d) wherein said elevator post is mounted for vertical movement through an opening in said platform between a load position wherein said pipe rest is remote from a level of said pipe rack to an unload position in which said pipe rest is adjacent to said level of said pipe rack;

(e) wherein said pipe is transported to said pipe rest when said elevator post is in its load position and said pipe rest is in its hold position;

(f) actuating said elevator to move said elevator post vertically from said load position to said unload position, whereby said pipe rest is adjacent to said level of said pipe rack; and (g) actuating said pipe rest to rotate said pipe rest from said hold position to said release position, whereby said pipe is released onto said pipe rack at said level.

20. The method of claim 19, wherein said pipe rest comprises:

(a) a cradle adapted to receive said pipe;

(b) said cradle being pivotably mounted to the top of said elevator post and adapted to pivot between said hold position and said release position.

21. The method of claim 19, wherein said elevator comprises a drive mechanism operably connected to said elevator post, said drive mechanism adapted to move said elevator post between its said load and unload positions.

22. A method of transporting pipe from a rig floor to a rack of pipe, said method comprising:

(a) transporting a pipe from said rig floor to a pipe rest mounted on an elongated, vertically extending post, said post being mounted for vertical movement through an opening in a platform, said platform extending horizontally adjacent said pipe rack, said post being at a load level and said pipe rest being in a hold position in which it retains said pipe therein;

(b) moving said post vertically to an unload level;

(c) rotating said pipe rest relative to a horizontal axis to a release position in which said pipe is released from said pipe rest onto said rack.

23. The method of claim 22, wherein said pipe rest comprises:

(a) a cradle adapted to receive said pipe;

(b) said cradle being pivotably mounted to the top of said post and adapted to pivot between said hold position and said release position.

24. The method of claim 23, wherein said cradle comprises a support portion in which said pipe may rest and a stop portion extending vertically from a side of said support portion.

25. The method of claim 22, wherein said post is supported at said load level by a tensile member and said post is moved to said unload level by actuating, said tensile member to move said post vertically.

* * * * *

UNITED STATES PATENT AND TRADEMARK OFFICE

CERTIFICATE OF CORRECTION

PATENT NO. : 9,057,227 B2
APPLICATION NO. : 13/815526
DATED : June 16, 2015
INVENTOR(S) : E. Kent Tolman et al.

It is certified that error appears in the above-identified patent and that said Letters Patent is hereby corrected as shown below:

IN THE SPECIFICATION

At column 7, line 31, delete “524” and insert therein -- 52 --.

IN THE CLAIMS

In claim 1, at column 11, line 66, delete “mil” and insert therein -- roll --.

In claim 6, at column 12, line 37, delete “engaging,” and insert therein -- engaging --.

In claim 15, at column 13, line 43, delete “vertical movement,” and insert therein -- vertical movement --.

In claim 19, at column 14, line 9, delete “Wherein” and insert therein -- wherein --.

In claim 25, at column 14, line 64, delete “actuating,” and insert therein -- actuating --.

Signed and Sealed this
Third Day of November, 2015

Michelle K. Lee

Michelle K. Lee
*Director of the United States Patent and Trademark Office*